US006840256B1

(12) United States Patent
Ryan et al.

(10) Patent No.: US 6,840,256 B1
(45) Date of Patent: Jan. 11, 2005

(54) PROCESS AND APPARATUS FOR SUPPLYING A GASEOUS MIXTURE

(75) Inventors: Robert Francis Ryan, Sans Souci (AU); William Patrick Shore, Enfield (AU)

(73) Assignee: Cytec Canada Inc., Niagara Falls (CA)

( * ) Notice: Subject to any disclaimer, the term of this patent is extended or adjusted under 35 U.S.C. 154(b) by 75 days.

(21) Appl. No.: 10/130,067

(22) PCT Filed: Nov. 17, 2000

(86) PCT No.: PCT/AU00/01403

§ 371 (c)(1),
(2), (4) Date: Sep. 27, 2002

(87) PCT Pub. No.: WO01/37979

PCT Pub. Date: May 31, 2001

(30) Foreign Application Priority Data

Nov. 19, 1999 (AU) ..... PQ 4163

(51) Int. Cl.[7] ..... B01F 3/02
(52) U.S. Cl. ..... 137/9; 43/125; 137/896
(58) Field of Search ..... 137/9, 896; 43/125

(56) References Cited

U.S. PATENT DOCUMENTS 4,889,708 A * 12/1989 Latif et al. ..... 424/43
5,271,908 A 12/1993 Shiban et al. ..... 422/228
5,353,829 A 10/1994 Shiban ..... 137/88
5,523,063 A 6/1996 Anderson ..... 422/224
5,662,722 A 9/1997 Shiban ..... 55/413
5,756,046 A * 5/1998 Winks et al. ..... 422/32
6,047,497 A * 4/2000 Smithyman et al. ..... 43/125

FOREIGN PATENT DOCUMENTS

AU A-44569/99 8/1999

* cited by examiner

*Primary Examiner*—Stephen M. Hepperle
(74) *Attorney, Agent, or Firm*—James A. Jubinsky; Fran Wasserman; Claire M. Schultz

(57) ABSTRACT

A method and apparatus for generating a non-flammable gaseous mixture from a first flammable gas and a second gas in which said first gas is flammable. Air may be extracted from the atmosphere or storage container to be treated. The air is circulated in a conduit (22) via blower (14). A flammable gas is injected (12) into the conduit where it is rapidly diluted to a level below its flammability limit. The method is suitable for unattended automatic treatment over an extended period of time, or a so-called "one shot/quick dump" fumigation where concentrations and flow rates are much higher and the process is under manual supervision.

17 Claims, 2 Drawing Sheets

PROCESS AND APPARATUS FOR SUPPLYING A GASEOUS MIXTURE

TECHNICAL FIELD

The present invention relates to dilution of gases and in particular dilution of flammable gases such as phosphine with air.

DISCLOSURE OF THE INVENTION

Any discussion of the prior art throughout the specification should in no way be considered as an admission that such prior art is widely known or forms part of common general knowledge in the field.

Many fumigants and sterilising gases are flammable. For instance, phosphine ($PH_3$) is used as a fumigant against insects infesting stored products such as grain. Phosphine has many desirable products as a fumigant including high penetrant ability, low sorption on foodstuffs and very low residue formation. It is, however, pyrophoric in air ie it will self-ignite. The flammability limit of phosphine in air 1.6% to 100%.

Current methods for using phosphine include generating phosphine from metallic phosphide tablets by exposure to moisture in ambient air.

The metallic phosphide tablets are a slow release formulation which take approximately two (2) days to release a very flammable high concentration phosphine gas mixture ie greater than 50% $PH_3$. This process also has a number of problems associated with the unreacted phosphide in spent tablets. In addition to the costs associated with disposal of such a hazardous waste, there are occupational health and safety issues in handling the spent tablets and potential residue problems.

To reduce this risk, many fumigants and sterilising gases are combined with a non-flammable liquid such as liquid carbon dioxide. Phosphine, for example, is generally marketed as a 2 wt % phosphine content in liquid carbon dioxide. Such a phosphine composition when contained in a 48 liter cylinder and under appropriate pressure will typically contain about 16.5 $m^3$ of gas at ambient temperature. When the phosphine composition is vaporised, the vaporised gas typically contains about 2.6% $PH_3$ in $CO_2$. While extensive studies of the flammability of phosphine show variations of phosphine flammability with temperature and pressure, the absolute flammability limit has been found to be 0.11% (1100 ppm) phosphine in air. Mixtures at less than this phosphine/oxygen ratio are not flammable irrespective of pressure. The highest recommended dosage of phosphine approved on the National Registration Authority authorised pesticide label is 700 ppm (which is equivalent to 1 g of $PH_3/m^3$).

The use of the non-flammable mixture of phosphine and liquid carbon dioxide overcomes some of the problems associated with the metallic phosphide tablets, however, when used to fumigate large or remote grain storage facilities, there is additional cost in cylinder handling, transport and utilisation issues.

One solution to avoid the cylinder handling issues is the on-site mixing of technical grade (99 wt %) phosphine which has proven to be beneficial. One proposal increases the contents of the cylinder containing such technical grade phosphine to 18 kg net which is equivalent to 29 of the old phosphine/liquid $CO_2$ cylinders. The normal arrangement of two cylinders containing technical grade phosphine with one in use and one on stand-by is equivalent to 58 of the older $PH_3/CO_2$ cylinders with a significant reduction in cylinder requirements, cylinder handling and manifolds for dispensing gas.

As will be appreciated by persons skilled in the art, however, remote locations are costly to service with liquid carbon dioxide because of long delivery distances involved and the under-utilised on-site liquid carbon dioxide storage vessels. These additional costs associated with remote areas eg typical grain growing regions, reduces the economic potential of gaseous phosphine fumigation. The pyrophoric properties of pure phosphine and indeed other sterilising gases has to date ruled out their direct mixing of with air.

The present invention seeks to overcome at least some of the disadvantages of the prior art or provide a commercial alternative thereto.

DISCLOSURE OF THE INVENTION

In a first aspect, the present invention provides a method of generating a non-flammable physiologically active gaseous mixture from a first flammable physiologically active gas and a second gas in which said first gas is flammable, said method comprising entraining the first flammable physiologically active gas in a turbulent stream of said second gas flowing at such a speed that the flammable gas is rapidly diluted to a level below its flammability limit, while maintaining physiological activity of the resultant mixture.

The flammable gas may be a fumigant selected from the group consisting of phosphine, propylene oxide, acrylonitrile, carbon disulphide, carbonyl sulphide, ethylene oxide, ethyl formate, hydrocyanic acid, methyl formate and mixtures thereof. In an other embodiment, the second gas is air.

In a further embodiment, the minimum flow rate of the turbulent gas stream is sufficient to extinguish any flame and/or sufficient to deliver the gaseous mixture to substantially all areas of the volume being treated with such gaseous mixtures. The flammable gas is preferably mixed with the second gas stream flowing at a speed of approximately 4 m/sec or greater.

The applicant has found that it is possible to provide a gaseous mixture on-site by mixing for example a flammable fumigant gas with air using the above-described method. By injecting for example phosphine, into a turbulent air stream the flammable phosphine is rapidly diluted to a level below its flammability limit and entrained with the rapidly moving air to avoid any possibility of combustion. Specially developed fail-safe dispensing equipment also allows on-site mixing of phosphine/air either manually or automatically controlled. The apparatus for carrying out the above method preferably includes such fail-safe dispensing equipment to shut down the process if the flammable fumigant gas or turbulent gas stream are outside the control specifications. The method provides a non-flammable fumigant composition which achieves all NRA approved application rates including those for pyrophoric gases such as phosphine. The resultant gaseous mixture is non-flammable under any ambient conditions as the composition is below the absolute flammability limit.

In a second aspect, the present invention provides an apparatus for generating a non-flammable physiologically active gaseous mixture from a first flammable physiologically active gas and a second gas in which said first gas is flammable, said apparatus comprising a first gas supply adapted to provide said flammable physiologically active gas, a second gas supply adapted to provide a turbulent stream of said second gas and a mixing zone adapted to receive and mix the first and second gases wherein the second gas supply is adapted to control the speed of the second gas flow to rapidly dilute the first gas to a level below its flammability limit and maintain a physiological activity of the resultant mixture.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to".

BRIEF DESCRIPTION OF THE DRAWINGS

So that the present invention may be more clearly understood it will now be described by way of example only with reference to the accompanying drawings in which.

BEST MODE FOR CARRYING OUT THE INVENTION

Figure 1:
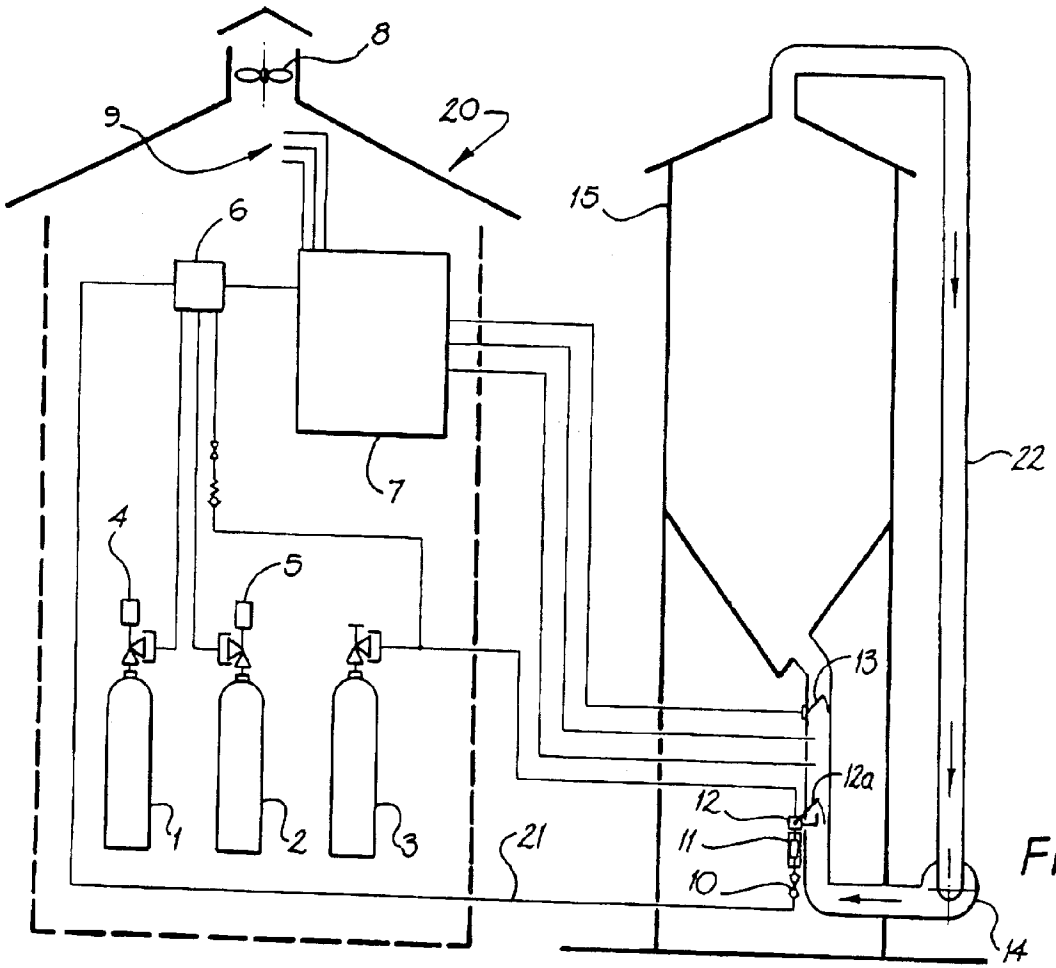
FIG. 1 is a diagrammatic view of an apparatus for providing a gas in accordance with the first embodiment of the present invention.
Figure 2:
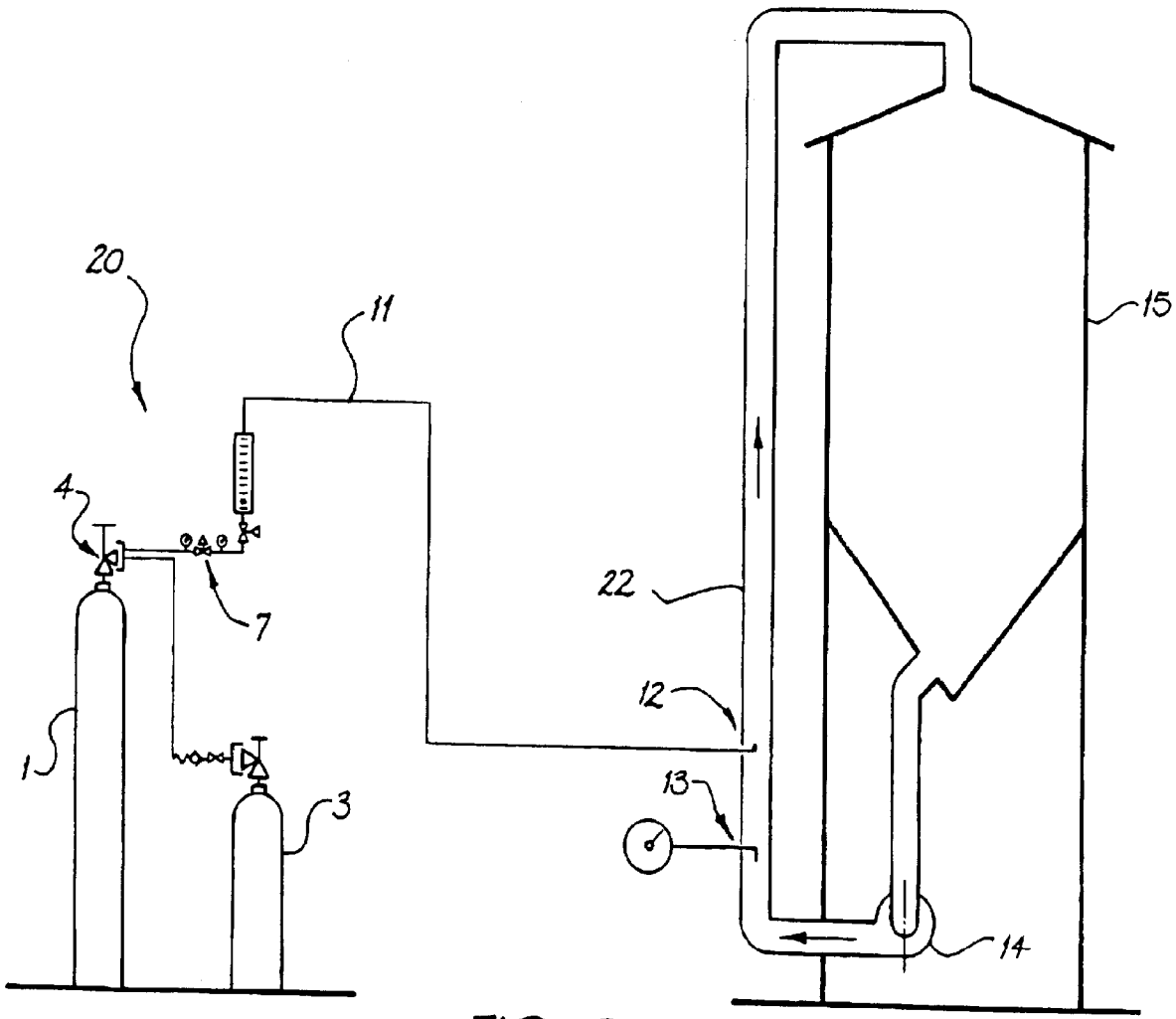
FIG. 2 is a diagrammatic flow chart of an apparatus for providing a gas in accordance with a second embodiment of the present invention.

In FIGS. 1 and 2, the inventive method and apparatus is used to provide a fumigant gas to a storage facility such as a grain silo. It will be understood, however, that the method and apparatus has a wider application than the provision of fumigant gas and the following embodiments should no way be considered as limiting the inventive idea.

In broad terms, FIGS. 1 and 2 relate to two variations of providing a fumigant gas to a grain silo. FIG. 1 is suitable for, but not limited to, unattended automatic fumigation of a grain silo over an extended period whereas FIG. 2 is more suited but not limited to, a rapid (1–2 hours) fumigation technique which may be controlled manually.

Turning firstly to FIG. 1, a typical grain silo 15 is to undergo fumigation. The fumigant supply apparatus 20 comprises a supply of fumigant gas, in this case technical grade phosphine in pressurised cylinders 1,2. Each cylinder is controlled by an appropriate valve actuator 4/5 which is connected in a conventional manner via manifold 6 to the overall process control means 7.

Purge gas supply means 3 provides an inert gas in this case carbon dioxide to purge the phosphine supply-line(s) 21 as will be discussed below. This purge gas supply means 3 and phosphine supply means 1,2 are all connected via manifold 6 to the phosphine supply line(s) 21.

Process control is handled via control means 7. This control means is connected to various flammable gas sensors, smoke detectors and air-flow sensors 9, 13 to ensure that the process remains strictly within the defined parameters.

Phosphine supply line 21 includes a control valve 10, flow indicator 11 and phosphine injector 12. The phosphine injector 12 includes a paddle wheel valve 12*a* which in tandem with air flow sensor 13, provides the necessary data to control means 7 to control or prevent injection of the fumigant phosphine gas if the turbulent gas stream drops below a predetermined flow speed. Air flow through conduit 22 is maintained by circulation blower 14. Turbulent flow is preferably maintained at all times.

As a further safety measure, exhaust fan 8 is provided in the fumigant gas supply housing 20.

The apparatus described above operates as follows: Firstly, $CO_2$ gas 3 is used to purge the phosphine injector 12 and supply line(s) 21. Blower 14 is activated and the control means 7 monitors the air flow speed in conduit 22. Once the air flow speed reaches the desired minimum value and is maintained at that level, valves 4/5 are opened and phosphine is directed via manifold 6 through supply line 21 to the phosphine injector 12 from where it is entrained in the turbulent gas flow into the silo 15 for fumigation of the grain or other material stored therein. In this embodiment, it is intended that the fumigant is diluted from essentially pure technical grade phosphine (99 wt %) to concentrations up to around 100 ppm and fed to the interior of the silo over an extended period, ie a number of days, even weeks. Blower 14 may continue to circulate the phosphine/air mixture throughout the silo to ensure thorough contact between the stored material and the fumigant gas. Simple calculations can determine the desired quantity of phosphine/air mixture which must be supplied to the silo 15 for adequate treatment. Once this has been achieved, the phosphine mixture is turned off and the supply line purged once again with $CO_2$ gas.

The speed of the turbulent stream of air into which the flammable fumigant gas (in this case the pyrophoric gas phosphine) is injected must be such as to rapidly dilute the gas to a level below its flammability limit.

In addition, by optimising injection of the first flammable gas and speed of the second gas to provide a non-flammable gaseous mixture, the method and apparatus can offer surprising benefits over conventional techniques. For example, grain storage facilities such as silos are generally situated in remote areas far from human contact. It is desirable to be able to provide a treatment apparatus which can be operated automatically, without human intervention. As mentioned above, the embodiment shown in FIG. 1 is primarily intended for treatment at low concentrations over an extended period of time. To adequately treat the storage facility and provide for a safe reliable process which does not require human intervention, the apparatus may be optimised such that the speed of the turbulent stream/gaseous mixture not only rapidly dilutes the flammable gas to below its flammability limit but also i) delivers the gaseous mixture to substantially all areas of the volume being treated, eg silo, and ii) extinguishes any ignition/burning of the flammable gas.

As will be appreciated by persons skilled in the art, it is obviously important to ensure that any gaseous treatment mixture contacts all areas of the volume to be treated. It is also important that any ignition or burning of the flammable mixture adjacent its injection point is rapidly extinguished. Surprisingly, it has been found that where the concentration of the flammable gas is around 100 ppm, a turbulent gas stream with a linear flow rate of around 4 m/sec is sufficient to rapidly dilute the first gas to below its flammability limit, deliver the resultant gaseous mixture to all parts of the silo and extinguish any flame which may occur adjacent the flammable gas injection point. In regard to this last point, the applicant has tested various flow speeds of the turbulent stream while providing continuous ignition (high voltage spark) directly adjacent the injection point. Surprisingly, it was found that rather than a minimum flow rate, a minimum linear flow rate of around 4 m/sec extinguished any resultant flame within a few centimeters of the ignition point.

Accordingly, it can be seen that the present method and apparatus effectively and reliably converts a flammable gas eg phosphine fumigant, to a non-flammable gaseous mixture for treatment while at the same time ensuring the resultant gaseous mixture reaches all parts of the volume to be treated and has a fail safe mechanism of extinguishing any flame/burning of the gaseous mixture.

Of course as mentioned above, the control means 7 is also connected to various additional gas sensors, air-flow sensors and smoke detectors, to further ensure safe operation of the apparatus shown in FIG. 1 without the need of manual operation.

Turning now to FIG. 2, this embodiment is primarily directed to, but not limited only, to a batch fumigation technique. This technique is sometimes referred to as a 'one shot' or 'quick dump' fumigation and is carried out over a few hours. With the one shot/quick dump process volumetric flows up to 20 times greater with concentrations up to 10 times greater are used. In view of the increased concentration and higher risk of ignition, the 1–2 hour fumigation period is at least partially manually supervised.

The process operates in a manner similar to that described in FIG. 1. Similar numerals in FIG. 2 identify similar components as FIG. 1. For instance, the fumigant supply apparatus 20 comprises a fumigant supply means 1 and purge gas supply means 3. Various flow indicators, valves etc 7 may be operated manually to control fumigant and purge gas supply as will be discussed below. A blower 14 is provided to maintain the turbulent air stream. An air flow sensor 13 is positioned within the conduit 22 circulating the gaseous mixture, just upstream of flammable gas injection point 12.

As with the first embodiment, after purging of the supply lines with inert gas, the fumigant gas is injected via line 11 into the turbulent air stream and into silo 15. As mentioned above, this is at a much higher rate than the embodiment of FIG. 1. Concentrations up to 1000 ppm are typical.

In order to dilute such a large quantity of flammable fumigant gas, larger quantities of air are required in the turbulent stream. Volumetric flows up to $10^3 m^3$ per half hour are typical but of course this will vary with the size of the storage container, conduit etc. With such a 'one shot' or 'quick dump' fumigation, the silo 15 is normally sealed. The required concentration of gaseous mixture is reached very quickly and, as with the first embodiment, blower 14 may continue to recirculate the resultant gaseous mixture through the silo to ensure thorough treatment, if necessary:

As will be appreciated by persons skilled in the art, the higher concentration and higher flow rates of the gaseous mixture in this second embodiment increase the possibility for ignition/explosion. Due to this fact and given that the treatment process only takes 1 to 2 hours, the 'one shot/quick dump' treatment is generally manually operated. In addition to this manual operation, however, other safety devices are used to monitor/isolate the flammable gas supplied in the event of ignition. Typically, various temperature and smoke sensors are used to shut off the flammable gas supply. Thermal fuses can also be used. These fuses comprise pressurised lines made from thermally sensitive material eg plastic. If ignition occurs, the thermally sensitive material degrades thereby releasing pressure in the lines tripping a valve 4 to close the flammable gas supply. In conjunction, the thermal fuse may also open the purge gas lines thereby removing any flammable mixture in the facility.

As with the first embodiment, tests were conducted to examine the consequence of deliberately igniting the gaseous mixture directly adjacent the phosphine injector 12. Flame lengths between 10 cm and 1 m long were produced. This was not surprising given the much higher concentration of flammable fumigant gas at the injection point. This can be reduced by using diffusers which increase dilution of the flammable fumigant gas. As with the first embodiment, the speed of the turbulent air stream can also be optimised to reduce the possibility of ignition/burning of the flammable gas. Given that the 'one shot/quick dump' fumigation system, however, will generally be conducted under manual supervision, ignition/burning of the flammable gas over a short distance from the ignition point is not as serious a problem as is continuous burning/ignition of the gas in the unattended process of FIG. 1.

With the proposed method and apparatus which provides a non-flammable gaseous mixture by combining technical grade 99% flammable gas, eg phosphine in cylinders and with air on site there will be a substantial reduction in costs arising from the disclosed method and apparatus. As mentioned above, such a cylinder with substantially pure phosphine therein will last considerably longer than the aforementioned commercial cylinders containing a 2 wt % phosphine/$CO_2$ mixture with consequent reduction in cylinder maintenance, handling and transport.

Another significant advantage over the prior art is that the quantity of phosphine added to the silo is comparatively small compared to the air volume of the silo thereby avoiding any prospect of over pressurisation of the silo. To explain, in conventional techniques which use low quantities of a fumigant gas in an inert gas carrier, eg $PH_3$ in $CO_2$, large volumes of this gaseous mixture must be fed to the silo to provide adequate treatment. With such large volumes, the possibility of over pressurisation, particularly in sealed storage vessels, is significant. With the present inventive technique, on the other hand, the air volume of the storage facility to be treated is simply dosed with a very small quantity of fumigant gas, ie only a few percentage points. There is virtually no prospect of over pressurisation by the addition of such a small quantity of fumigant gas. In addition, in order to re treat a storage facility, the existing gas may be removed, 'topped up' with a fumigant gas and recycled back to the storage container. With conventional techniques, the entire contents of the storage facility would have to be removed and re-filled with fresh fumigant gas. Not only is this wasteful and time consuming but the potentially still dangerous gaseous mixture is normally vented to the atmosphere leading to potential environmental difficulties.

It will be appreciated that the disclosed method and apparatus may be embodied in other forms without departing from the spirit or scope of the present invention.

What is claimed is:

1. A method of generating a non-flammable physiologically active gaseous mixture from a first flammable physiologically active gas and a second gas in which said first gas is flammable, said method comprising entraining the first flammable physiologically active gas in a turbulent stream of said second gas flowing at such a speed that the flammable gas is rapidly diluted to a level below its flammability limit, while maintaining physiological activity of the resultant mixture, wherein the minimum flow rate of the turbulent second gas stream is sufficient to extinguish any flame.

2. A method as claimed in claim 1, wherein the minimum flow rate of the turbulent stream is sufficient to deliver the gaseous mixture to substantially all areas of the volume being treated with such gaseous mixture.

3. A method as claimed in claim 1, wherein the flammable physiologically active gas is a fumigant.

4. A method as claimed in claim 1, wherein the flammable gas is pyrophoric.

5. A method as claimed in claim 1, wherein the flammable gas is selected from the group consisting of phosphine, propylene oxide, acrylonitrile, carbon disulphide, carbonyl sulphide, ethylene oxide, ethyl formate, hydrocyanic acid, methyl formate and mixtures thereof.

6. A method as claimed in claim 1, wherein the second gas is air.

7. A method as claimed in claim 1, wherein the second gas stream is flowing at a speed of approximately 4 m/s or greater.

8. A method as claimed in claim 1, wherein the flammable gas is diluted to a range of about 10–1000 ppm.

9. A method as claimed in claim 1, wherein the flammable gas is injected via one or more localised injection points into the turbulent stream of second gas.

10. A method as claimed in claim 1, wherein the second gas is extracted from a container to be treated with the non-flammable gaseous mixture, and mixed with the flammable gas prior to re-entry into the container.

11. An apparatus for generating a non-flammable physiologically active gaseous mixture from a first flammable physiologically active gas and a second gas in which said first gas is flammable, said apparatus comprising a first gas supply adapted to provide said flammable physiologically active gas, a second gas supply adapted to provide a turbulent stream of said second gas and a mixing zone adapted to receive and mix the first and second gases wherein the second gas supply is adapted to control the speed of the second gas flow to rapidly dilute the first gas to a level below its flammability limit and maintain a physiological activity of the resultant mixture, wherein the second gas supply maintains a minimum flow rate of the turbulent gas stream sufficient to extinguish any flame.

12. An apparatus as claimed in claim 11 wherein the first gas supply is adapted to provide a fumigant.

13. An apparatus as claimed in claim 11 wherein the second gas supply maintains a minimum flow rate of the turbulent gas stream sufficient to deliver the gaseous mixture to substantially all there is of the volume being treated with such gaseous mixture.

14. An apparatus as claimed in claim 11, wherein the second gas supply is adapted to extract gas from within the container to be treated with a non-flammable gaseous mixture, and mix the flammable gas with the extracted gas prior to re-entry into the container.

15. An apparatus as claimed in claim 11, further comprising one or more injectors for injection of the flammable gas into the turbulent stream of second gas.

16. An apparatus as claimed in claim 15 further comprising one or more diffusers at respective localised injection points to increase dilution of the flammable gas in the turbulent stream of second gas.

17. An apparatus as claimed in claim 11, further comprising control means adapted to control flammable gas supply and/or purge all gas lines with an inert gas.

* * * * *